US009765964B2

(12) United States Patent
Haugstetter

(10) Patent No.: US 9,765,964 B2
(45) Date of Patent: Sep. 19, 2017

(54) SYSTEM FOR BOILER CONTROL

(75) Inventor: Christoph Haugstetter, West Hartford, CT (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 801 days.

(21) Appl. No.: 14/119,504

(22) PCT Filed: May 23, 2011

(86) PCT No.: PCT/US2011/037536
§ 371 (c)(1),
(2), (4) Date: Nov. 22, 2013

(87) PCT Pub. No.: WO2012/161687
PCT Pub. Date: Nov. 29, 2012

(65) Prior Publication Data
US 2014/0114483 A1 Apr. 24, 2014

(51) Int. Cl.
*F23N 5/00* (2006.01)
*F23N 1/00* (2006.01)
(Continued)

(52) U.S. Cl.
CPC ..... *F23N 5/00* (2013.01); *F22B 35/00* (2013.01); *F23N 1/002* (2013.01); *F23N 5/003* (2013.01);
(Continued)

(58) Field of Classification Search
CPC . F23N 5/00; F23N 1/002; F23N 5/003; F23N 2041/04; F22B 35/00; F23C 2205/10; F24H 9/20
See application file for complete search history.

(56) References Cited

U.S. PATENT DOCUMENTS 4,362,269 A 12/1982 Rastogi
2002/0101212 A1 8/2002 Okai
(Continued)

FOREIGN PATENT DOCUMENTS

EP 1855053 A1 11/2007
JP 2008241092 A 10/2008

OTHER PUBLICATIONS

PCT International Report on Patentability and Written Opinion of the International Searching Authority for International Application No. PCT/US2011/037536 dated Dec. 5, 2013, 7 pages.
(Continued)

*Primary Examiner* — Shogo Sasaki
(74) *Attorney, Agent, or Firm* — Cantor Colburn LLP

(57) ABSTRACT

A system for boiler control is provided. The system includes supply units to provide supplies of combustion materials for combustion thereof, a vessel coupled to the supply units in which the combustion materials are combusted, a carbon monoxide (CO) sensor disposed at an outlet of the vessel to sense a quantity of exhaust CO output from the vessel as a product of combustion therein and a control unit. The control unit is coupled to the supply units and the sensor and configured to issue a main servo command and a pulse servo command to one or more of the supply units to control operations of the one or more supply units in accordance with the sensed quantity of the exhaust CO.

14 Claims, 3 Drawing Sheets

(51) Int. Cl.
*F22B 35/00* (2006.01)
*F24H 9/20* (2006.01)

(52) U.S. Cl.
CPC ..... *F23C 2205/10* (2013.01); *F23N 2041/04* (2013.01); *F24H 9/20* (2013.01)

(56) References Cited

U.S. PATENT DOCUMENTS

| | | | | |
|---|---|---|---|---|
| 2007/0099137 | A1 | 5/2007 | Donnelly et al. | |
| 2007/0111148 | A1* | 5/2007 | Wells | F23N 1/022 431/12 |
| 2007/0119349 | A1 | 5/2007 | Widmer | |
| 2009/0223466 | A1* | 9/2009 | Knorr, Jr. | F22B 35/00 122/448.1 |

OTHER PUBLICATIONS

Extended European Search Report issued in EP Application No. 11866244.4; Mar. 4, 2015; 6 pages.

* cited by examiner

SYSTEM FOR BOILER CONTROL

STATEMANT OF FEDERAL SUPPORT

This invention was made with government support under W912HQ-10-C-0073 awarded by the U.S. Army Aviation & Missile Command. The government has certain rights in the invention.

BACKGROUND OF THE INVENTION

Aspects of the invention are directed to a system for boiler control.

Today's state-of-the-art boiler controllers are designed and tuned to run at or above a given quantity of exhaust gas O2. This is done for reasons of safety (carbon monoxide, flame stability), emission regulations and operational robustness but results in an efficiency penalty. Since CO is not measured, conservative margins are built into boiler systems in order to avoid violation of operational constraints. These conservative margins further erode efficiency.

BRIEF DESCRIPTION OF THE INVENTION

A system for boiler control is provided. The system includes supply units to provide supplies of combustion materials for combustion thereof, a vessel coupled to the supply units in which the combustion materials are combusted, a carbon monoxide (CO) sensor disposed at an outlet of the vessel to sense a quantity of exhaust CO output from the vessel as a product of combustion therein and a control unit. The control unit is coupled to the supply units and the sensor and configured to issue a main servo command and a pulse servo command to one or more of the supply units to control operations of the one or more supply units in accordance with the sensed quantity of the exhaust CO.

Issuance of the main servo command provides baseline amounts of the combustion materials for combustion for baseline amounts of time. Issuance of the pulse servo command increases the amount of the combustion materials provided for combustion beyond the baseline amounts for short times that are shorter than the baseline amounts of time.

A method of boiler control is provided. The method includes issuing a main servo command to one or more supply units coupled to a vessel for providing baseline amounts of the combustion materials to the vessel for combustion thereof within the vessel for baseline amounts of time and issuing a pulse servo command to the one or more supply units to increase the amount of the combustion materials provided for combustion thereof beyond the baseline amounts for short times that are shorter than the baseline amounts of time. The method further includes sensing a quantity of carbon monoxide (CO) produced by combustion within the vessel and controlling the issuing of the main and pulse servo commands in accordance with at least the sensed quantity of the CO.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
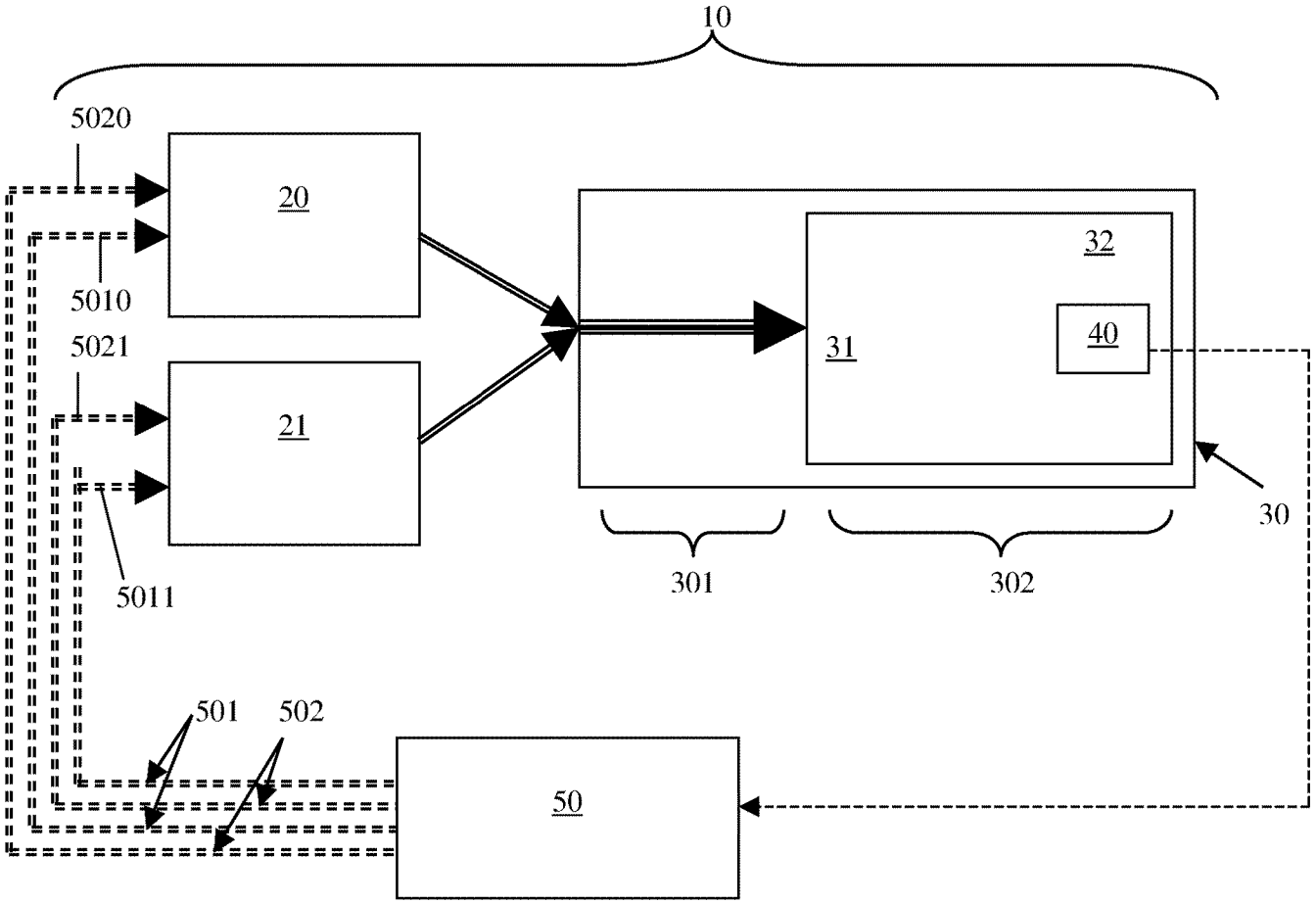
FIG. 1 is a schematic diagram of a boiler apparatus.

With reference to FIG. 1, a boiler apparatus 10 is provided. The boiler apparatus 10 includes first and second supply units 20, 21, a vessel 30, a carbon monoxide (CO) sensor 40 and a control unit 50. The first and second supply units 20, 21 are configured to provide supplies of combustion materials for combustion thereof to an interior 31 of the vessel 30, which is coupled to the first and second supply units 20, 21, and in which combustion of the combustion materials occurs. The carbon monoxide (CO) sensor 40 is disposed at an outlet 32 of the interior 31 of the vessel 30 to sense a quantity of exhaust CO that is output from the vessel 30 as a product of combustion therein. The control unit 50 is coupled to the first and second supply units 20, 21 and to the sensor 40. The control unit 50 is configured to issue a main servo command 501 and a pulse servo command 502 (see FIG. 2) to one or more of the first and second supply units 20, 21 to control operations thereof in accordance with the sensed quantity of the exhaust CO.

Typically, fuel flow in a boiler is scheduled (statically) based on a 'firing rate' (a controller internal variable that another controller dynamically computes, based, e.g., on water temperature or steam pressure). In some systems, air flow is also scheduled based on the firing rate, while in other systems air flow is controlled to a firing rate dependant setpoint. For CO based control, this setpoint can be dynamically adjusted based on measurements of the sensed quantity of the exhaust CO. The pulse servo command 502 (or a 'MicroPulse') enables CO based control while limiting large CO excursions.

All boilers run 'lean' (as opposed to stoichiometric like in a typical gasoline driven internal combustion engine) meaning there is always a surplus of air being flown into the boiler. An air-fuel ratio of 1.1 means that 10% more air than is stoichiometrically necessary is present. An objective of the pulse servo command 502 (i.e., the 'MicroPulse') is to temporarily lean-out the mixture to, for example, a ratio of 1.07. This can be achieved in various manners including, but not limited to, adding more fuel or flowing less air. These operations are functionally nearly equivalent and interchangeable and the choice between them depends on engineering considerations (e.g. actuator speed).

In accordance with embodiments, the vessel 30 may be a combustor of, for example, a gas turbine engine. In this and other similar cases, the first supply unit 20 provides a supply of air for combustion thereof to the interior 31 of the vessel 30 and the second supply unit 21 provides a supply of fuel for combustion thereof to the interior 31 of the vessel 30. The vessel 30 further includes a mixing 301 section in which the combustion materials (i.e., the air and fuel) are mixed and a combustion section 302. The combustion section 302 is disposed downstream from the mixing section 301 and is formed to define the interior 31 where combustion of the combustion materials occurs. The combustion section 302 is further formed to define the outlet 32 where the sensor 40 is disposed.

Figure 2:
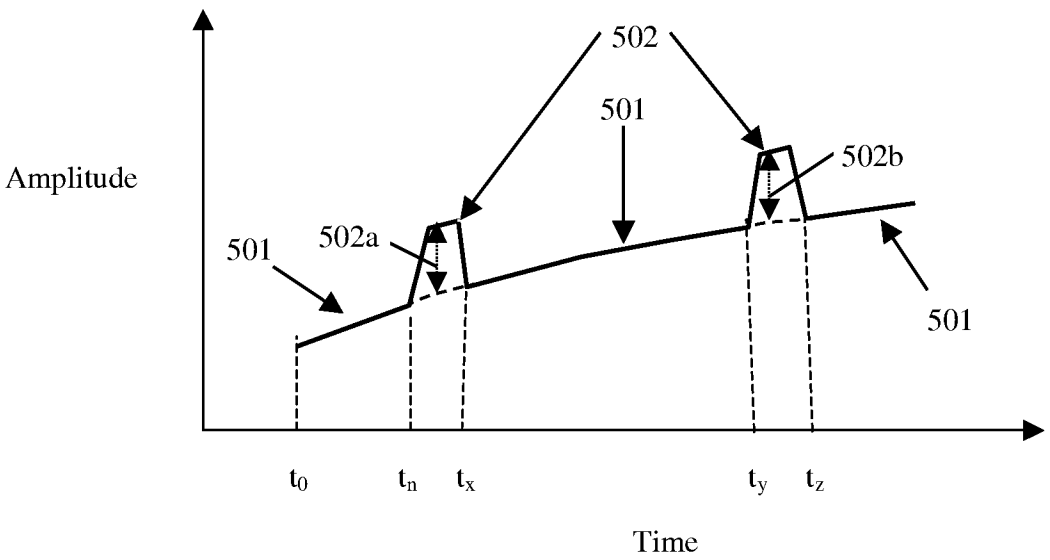
FIG. 2 is a graphical display of main and pulse servo commands for use with the boiler apparatus of FIG. 1.

With reference to FIGS. 1 and 2, the main servo command 501 includes one or both of a first base command 5010 to be issued to the first supply unit 20 and a second base command 5011 to be issued to the second supply unit 21. The first base command 5010 instructs the first supply unit 20 to provide to the interior 31 of the vessel 30 a baseline amount of air for combustion thereof for a baseline amount of time. The second base command 5011 instructs the second supply unit 21 to provide to the interior 31 of the vessel 30 a baseline amount of fuel for combustion thereof for a baseline amount of time. In accordance with embodiments, the respective baseline amounts of air, fuel and time may be associated with a boiler baseline performance of the boiler apparatus 10.

The pulse servo command 502 includes one or both of a first additional command 5020 to be issued to the first supply unit 20 and a second additional command 5021 to be issued to the second supply unit 21. The first additional command 5020 instructs the first supply unit 20 to decrease the amount of air provided to the interior 31 of the vessel 30 for combustion thereof beyond the baseline amount of the air for a short time that is shorter than the baseline amount of time. The second additional command 5021 instructs the second supply unit 21 to increase the amount of fuel provided to the interior 31 of the vessel 30 for combustion thereof beyond the baseline amount of the fuel for a short time that is shorter than the baseline amount of time.

As shown in FIG. 2, the main servo command 501 is variable over time and may increase over time by a steadily decreasing amount to an equilibrium at which no further increase occurs. The pulse servo command 502 is also variable over time and issued periodically. In accordance with an embodiment, the pulse servo command 502 may be issued for approximately 5 seconds every 30 seconds although it is to be understood that this is merely exemplary and that other frequencies and periods are possible. In this way, the pulse servo command 502 probes whether a current operating point of the boiler apparatus 10 as established by the main servo command 501 is near a critical air and fuel ratio at which a quantity of exhaust CO as sensed by the sensor 40 starts to rise sharply. The time displacement between each pulse accounts for the delay that would be expected before results of the pulse would be sensed. Since the pulse is relatively short, the time spent with such probing in effect is limited so as to limit the exhaust of an increased amount of CO for an extended period of time.

In particular, from time $t_0$ to time $t_n$, the control unit 50 issues the main servo command 501 to one or more of the first and second supply units 20, 21. The main servo command 501 instructs the one or more of the first and second supply units 20, 21 to steadily decrease/increase the corresponding supply(ies) of the air and/or fuel to interior 31 of the vessel 30. From time $t_0$ to time $t_x$, the control unit 50 issues the pulse servo command 502 on top of the main servo command 501 as an instruction to decrease/increase the corresponding supply(ies) of the air and/or fuel for time $t_0$ to time $t_x$. At time $t_x$, the pulse servo command 502 ceases and the main servo command 501 continues to be issued and steadily decreased/increased by the control unit 50. The period from time $t_x$ to time $t_y$ is set to be sufficiently long relative to transport delays in the vessel 30 such that CO produced by the combustion therein can be sensed by the sensor 40 whereby the sensor 40 is able to determine whether the critical air and fuel ratio at which the quantity of exhaust CO starts to rise sharply has been or is soon to be reached without the apparatus 10 spending a significant amount of time in that air and fuel ratio range. If the sensor 40 determines that the critical air and fuel ratio has not been and will not soon be reached, the process continues with the control unit 50 again issuing the pulse servo command 502 on top of the main servo command from time $t_y$ to time $t_z$. At time $t_z$, the pulse servo command 502 ceases and the main servo command 501 continues to be issued and steadily increased by the control unit 50 until the sensor 40 determines that the critical air and fuel ratio has been or will soon be increased. Once that occurs, the pulse servo command 502 is no longer issued and the main servo command 501 is no longer increased at a significant rate by the control unit 50.

With the control unit 50 coupled to the first and second supply units 20, 21 and the sensor 40, the control unit 50 is able to vary both the main servo command 501 and the pulse servo command 502 over time in accordance with at least the sensed quantity of the exhaust CO (and possibly other sensed properties, such as O2). That is, while the main servo command 501 can be steadily increased over time as described above, the pulse servo command 502 may be constant relative to the main servo command over time or decreased relative to the main servo command 501 over time. That is, a magnitude of 502*a* may be substantially similar to or different from a magnitude of 502*b*. For the latter case where 502*a* and 502*b* are different, the probing of the critical air and fuel ratio by the issuance of the pulse servo command 502 can therefore be achieved to an increasingly limited degree with an associated increased limitation of CO emissions. The degree to which the pulse servo command 502 is decreased relative to the main servo command 501 over time can be based on sensor 40 readings and/or historical CO emissions data for the apparatus 10.

As mentioned above, the control unit 50 is able to cease issuance of the pulse servo command 502 in accordance with the sensed quantity of the exhaust CO. Still further, the control unit 50 may cease issuance of the pulse servo command 502 when the sensed quantity of the exhaust CO indicates that the main servo command 501 has been reached, will soon be reached or substantially approximates the critical air and fuel ratio (or an acceptable range thereof). The pulse servo command 502 may later resume as soon as the sensed quantity of the exhaust CO indicates a sufficiently large margin from the critical region.

Figure 3:
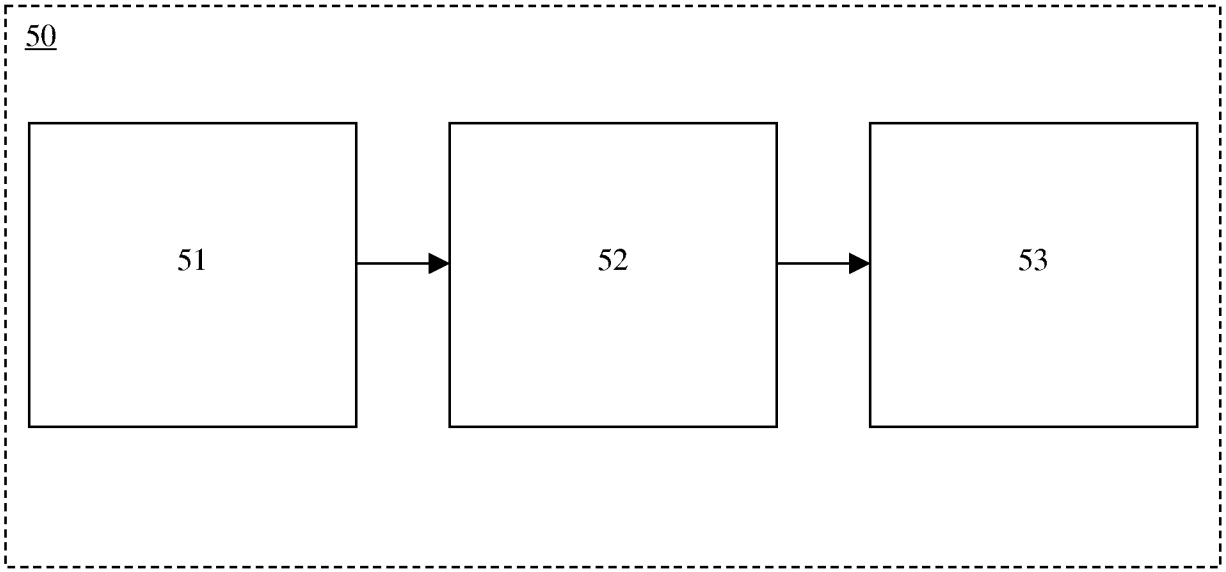
FIG. 3 is a schematic diagram of components of an exemplary control unit of the boiler apparatus of FIG. 1.

With reference to FIG. 3, the control unit 50 includes an input unit 51, a calculation unit 52 and an output unit 53. The input unit 51 serves to allow an input of conditions (i.e., sampling time, triggering period, pulse duration) for triggering issuance of the pulse servo command 502 as well as an input of a form and type (i.e., pulse height) of the pulse servo command 502. The calculation unit 52 determines whether the input conditions are currently met. The output unit 53 converts an affirmative result of the determination of the calculation unit 52 into a trigger to issue the servo pulse command 502.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for boiler control, comprising:

supply units responsive to main and pulse servo commands to provide supplies of combustion materials for combustion thereof;

a vessel coupled to the supply units and receptive of the combustion materials, the vessel being configured to define an interior in which the combustion materials are combusted and an outlet through which combustion products flow following combustion;

a carbon monoxide (CO) sensor disposed at the outlet to sense a quantity of exhaust CO output from the interior as one of the combustion products; and a control unit coupled to the supply units and the sensor, the control unit being configured to issue the main servo command to be variable over time and the pulse servo command to be variable over time relative to the main servo command to one or more of the supply units to control operations thereof in accordance with the sensed quantity of the exhaust CO, wherein:

the main servo command is variable over time and comprises a first command for providing a baseline amount of air for combustion thereof for a baseline amount of time, the pulse servo command comprises an additional command to decrease the amount of air provided for combustion thereof beyond the baseline amount for a short time that is shorter than the baseline amount of time and is variable relative to the main servo command over time.

2. The system according to claim 1, wherein the supply units comprise:

a first supply unit to provide a supply of air for combustion thereof; and a second supply unit to provide a supply of fuel for combustion thereof.

3. The system according to claim 1, wherein the vessel comprises:

a mixing section in which the combustion materials are mixed; and a combustion section, which is defined downstream from the mixing section relative to a predominant flow direction through the vessel, in which combustion of the combustion materials occurs.

4. The system according to claim 1, wherein the main servo command comprises:

a first command for providing a baseline amount of air for combustion thereof for a baseline amount of time; and a second command for providing a baseline amount of fuel for combustion thereof for a baseline amount of time.

5. The system according to claim 4, wherein the respective baseline amounts of air, fuel and time are associated with boiler baseline performance.

6. The system according to claim 4, wherein the pulse servo command comprises an additional command to increase the amount of fuel provided for combustion thereof beyond the baseline amount for a short time that is shorter than the baseline amount of time.

7. The system according to claim 1, wherein the main servo command is variable over time.

8. The system according to claim 1, wherein the main pulse servo command is variable over time.

9. The system according to claim 1, wherein the pulse servo command is variable over time and issued periodically.

10. The system according to claim 1, wherein the pulse servo command is issued for approximately 5 seconds every 30 seconds.

11. The system according to claim 1, wherein the control unit varies the main servo command over time and ceases issuance of the pulse servo command in accordance with the sensed quantity of the exhaust CO.

12. The system according to claim 1, wherein the control unit ceases issuance of the pulse servo command when the sensed quantity of the exhaust CO indicates that the main servo command substantially approximates a critical air and fuel ratio.

13. The system according to claim 1, wherein the control unit comprises:

an input unit by which conditions for triggering issuance of the pulse servo command are input;

a calculation unit by which it is determined whether the input conditions are currently met; and an output unit by which an affirmative result of the determination of the calculation unit is converted into a trigger to issue the servo pulse command.

14. The system according to claim 13, wherein sampling time, triggering period, pulse duration and pulse height of the pulse servo command are input by way of the input unit.

* * * * *